US005692403A

United States Patent [19]

Ling

[11] Patent Number: 5,692,403

[45] Date of Patent: Dec. 2, 1997

[54] DOUBLY LOCKABLE BELT LOCKING DEVICE

[76] Inventor: Chong-Kuan Ling, c/o Sinox Co., Ltd. P.O. Box 96-156, Taipei, Taiwan

[21] Appl. No.: 676,415

[22] Filed: Jul. 8, 1996

[51] Int. Cl.[6] ..... E05B 37/02

[52] U.S. Cl. ..... 70/312; 70/57; 70/70

[58] Field of Search ..... 70/2–13, 57, 58, 70/30, 49, 69–72, 74–76, 312, 316–318

[56] References Cited

U.S. PATENT DOCUMENTS

| | | | |
|---|---|---|---|
| 1,312,601 | 8/1919 | Wolf | 70/71 |
| 2,912,844 | 11/1959 | Atkinson | 70/75 |
| 2,970,858 | 2/1961 | Norrenberg-Sudhaus | 70/75 X |
| 3,478,547 | 11/1969 | Constable | 70/71 |
| 3,482,421 | 12/1969 | Franzen | 70/74 |
| 3,523,436 | 8/1970 | Chance | 70/75 |
| 3,597,945 | 8/1971 | Feinberg | 70/74 X |
| 3,736,778 | 6/1973 | Bako | 70/74 X |
| 4,100,775 | 7/1978 | Bako | 70/3 |
| 4,318,287 | 3/1982 | Remington et al. | 70/71 |
| 4,782,673 | 11/1988 | Castelli et al. | 70/72 |
| 4,912,950 | 4/1990 | Crowle | 70/58 |
| 5,117,663 | 6/1992 | Ida | 70/71 X |
| 5,193,368 | 3/1993 | Ling | 70/57 X |
| 5,517,836 | 5/1996 | Hong | 70/57 X |

*Primary Examiner*—Suzanne Dino

[57] ABSTRACT

A belt locking device includes: a housing including a base member having a first belt end of a fastening belt fixed in the base member and having a base engaging portion formed on the base member for detachably engaging a second belt end of the fastening belt, and a cover member combinable with the base member; a primary lock resiliently slidably held in the cover member and partially protruding outwardly from the cover member and having a movable engaging portion formed on the primary lock to be engageable with the base engaging portion of the base member for locking the second belt end of the fastening belt in between the cover member and the base member of the housing, whereby upon depression of the primary lock to disengage the movable engaging portion of the primary lock from the base engaging portion of the base member, the second belt end of the fastening belt is removable from the base member; and a secondary lock secured in the housing and operatively locking and unlocking the primary lock within the housing, thereby safely enhancing a double locking of the belt locking device.

3 Claims, 5 Drawing Sheets

DOUBLY LOCKABLE BELT LOCKING DEVICE

BACKGROUND OF THE INVENTION

For ensuring the fastening of a big luggage, a belt is always provided to fasten the luggage casing and its cover for preventing unexpected opening of the luggage even though a locking device already provided on the casing and the cover of the luggage has been locked. Such a fastening belt is provided to enhance the closing of the luggage since the locking device mounted on the casing and cover may be broken, damaged, intruded unintentionally or intentionally, or even unlocked due to user's carelessness.

However, the conventional fastening belt for fastening the luggage may be easily loosened to lose its fastening effect.

The present inventor has found the drawback of the conventional luggage belt and invented the present belt locking device with double locking mechanisms.

SUMMARY OF THE INVENTION

The object of the present invention is to provide a belt locking device comprising: a housing including a base member having a first belt end of a fastening belt fixed in the base member and having a base engaging portion formed on the base member for detachably engaging a second belt end of the fastening belt, and a cover member combinable with the base member; a primary lock resiliently slidably held in the cover member and partially protruding outwardly from the cover member and having a movable engaging portion formed on the primary lock to be engageable with the base engaging portion of the base member for locking the second belt end of the fastening belt in between the cover member and the base member of the housing, whereby upon depression of the primary lock to disengage the movable engaging portion of the primary lock from the base engaging portion of the base member, the second belt end of the fastening belt is removable from the base member; and a secondary lock secured in the housing and operatively locking and unlocking the primary lock within the housing, thereby providing double locking effect for the belt locking device for safety purpose.

DETAILED DESCRIPTION

Figure 1:
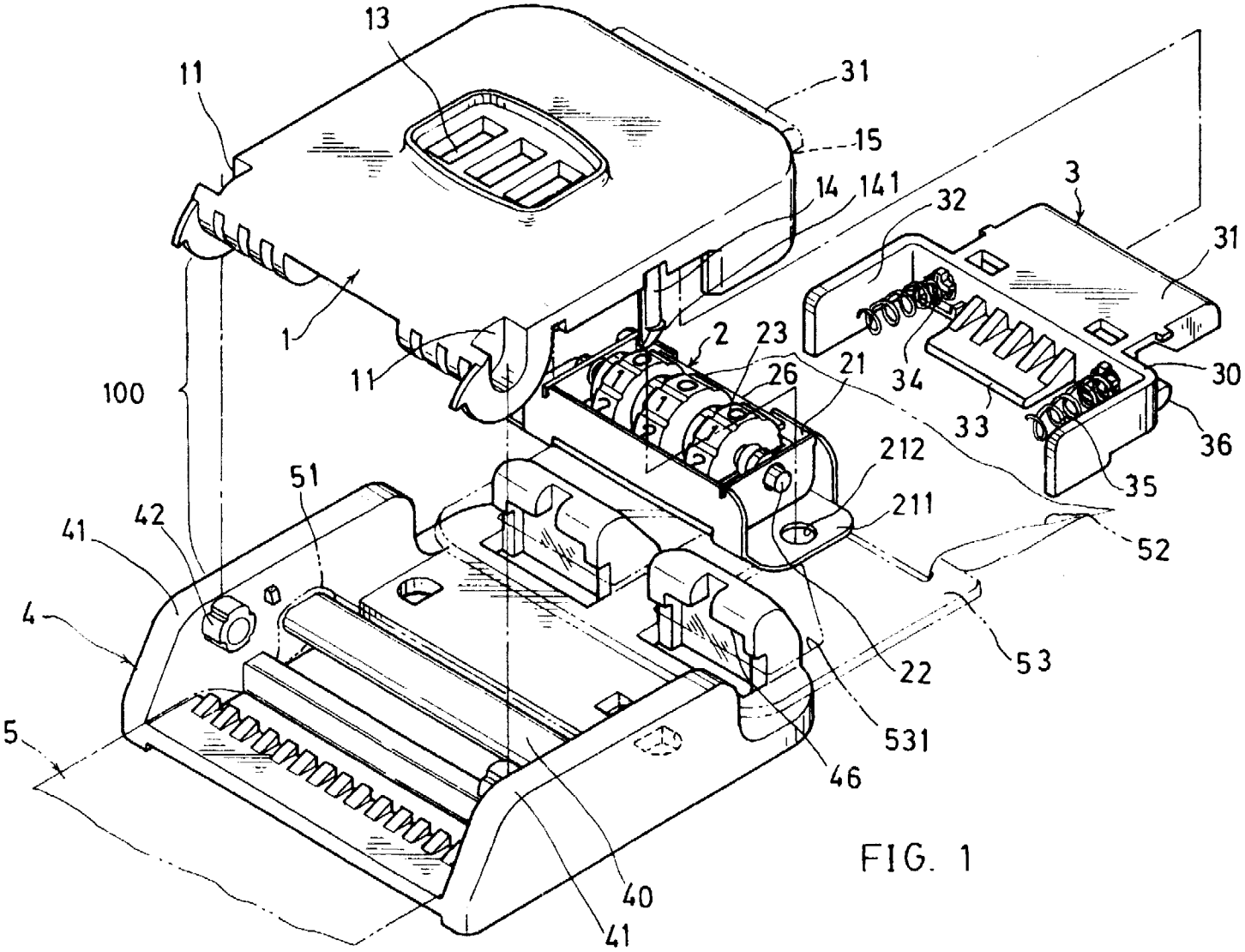
FIG. 1 is an exploded view of the elements of the present invention.
Figure 2:
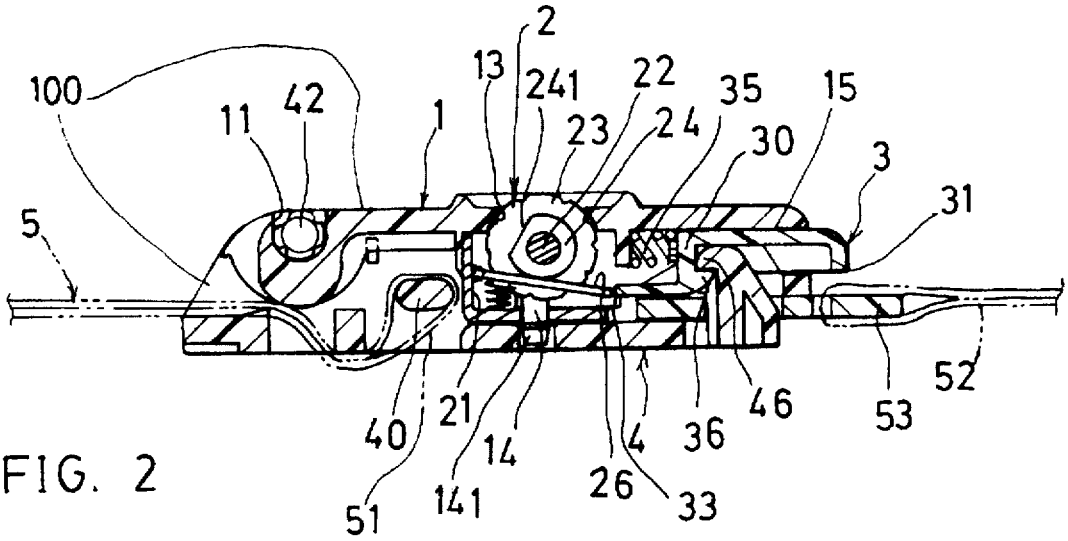
FIG. 2 is a longitudinal sectional drawing of the present invention when assembled and locked.

As shown in FIGS. 1–5, a preferred embodiment of the belt locking device of the present invention comprises: a housing 100 consisting of a base member 4 and a cover member 1 combinable with the base member 4, a primary lock 3 resiliently slidably held in the housing 100 particularly in the cover member 1, and a secondary lock 2 secured in the housing 100 particularly secured in the cover member 1, and a fastening belt 5 for fastening a luggage or other containers or articles.

The base member 4 includes: at least a pair of side walls 41 having a pair of pivots 42 formed on the two side walls 41 for pivotally mounting the cover member 1 on the base member 4, a belt bar 40 transversely formed in the base member 4 for securing a first belt end 51 of the fastening belt 5, and at least a base engaging portion 46 protruding upwardly from the base member 4 for engaging a second belt end 52 of the fastening belt 5. The second belt end 52 may be formed with a buckle member 53 having an opening 531 slotted in the buckle member 53 for engaging the base engaging portion 46 of the base member 4.

The cover member 1 includes: a pair of pivot holes 11 formed in two opposite side portions of the cover member 1 for pivotally engaging the two pivots 42 formed on the base member 4, at least a manipulating slot 13 formed through the cover member 1 for protruding a portion of the secondary lock 2 for locking or unlocking operation of the secondary lock 2, a pair of stems 14 each stem 14 protruding downwardly from the cover member having a bottom hook portion 141 formed on a bottom of the stem 14 for engaging a bottom hook hole 212 formed in a lock bottom plate 211 of the lock casing 21 of the secondary lock 2, and a tongue slot 15 transversely formed in the cover member 1 for protruding a portion of the primary lock 3 for the unlocking operation of the primary lock 3.

The primary lock 3 includes: a tongue portion 31 protruding outwardly from a shoulder portion 30 of the primary lock 3 to be slidably held in the tongue slot 15 in the cover member 1, a pair of side arm portions 32 protruding inwardly from the shoulder portion 30 within the cover member 1, a retarding extension 33 protruding inwardly from the shoulder portion 30 and retractably obstructed by the secondary lock 2 when locked, at least a latch restoring spring 35 held on a spring retainer 34 formed on the shoulder portion 30, and at least a movable engaging portion 36 protruding downwardly from the cover member 1 to be engageable with the base engaging portion 46 of the base member 4 for locking the primary lock 3 on the base member 4 and for locking the second belt end 52 or its buckle member 53 within the housing 100 consisting of the base member 4 and the cover member 1.

The secondary lock 2 may be made as a module means or unit detachably embedded or secured in the cover member 1 or in the housing 100 for a quicker assembly or maintenance of the locking device of the present invention.

Figure 5:
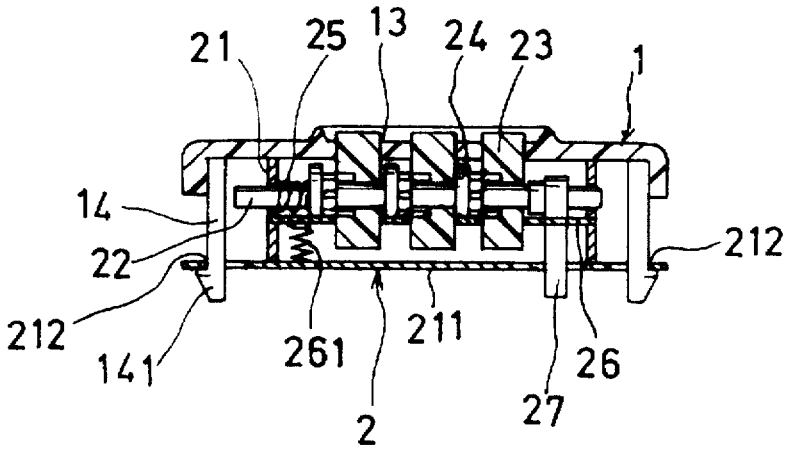
FIG. 5 is a longitudinal sectional drawing of the secondary lock along the axle of the secondary lock of the present invention.
Figure 6:
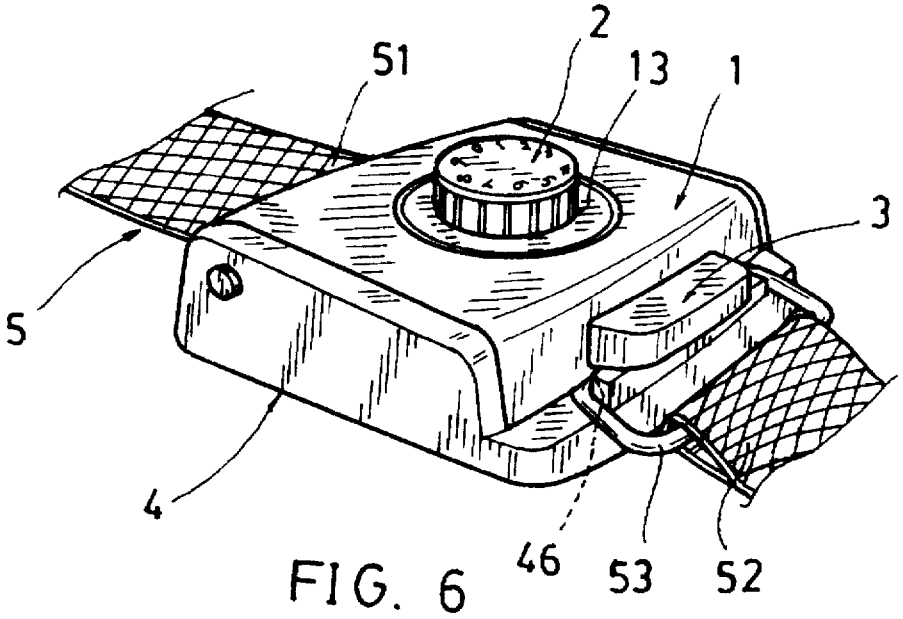
FIG. 6 is a perspective view of another preferred embodiment of the present invention.
Figure 7:
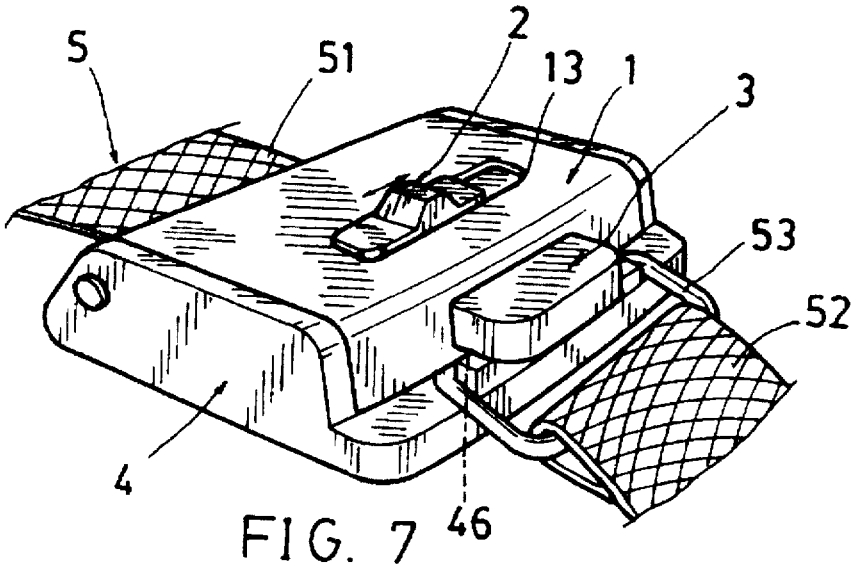
FIG. 7 shows still another preferred embodiment of the present invention.
Figure 8:
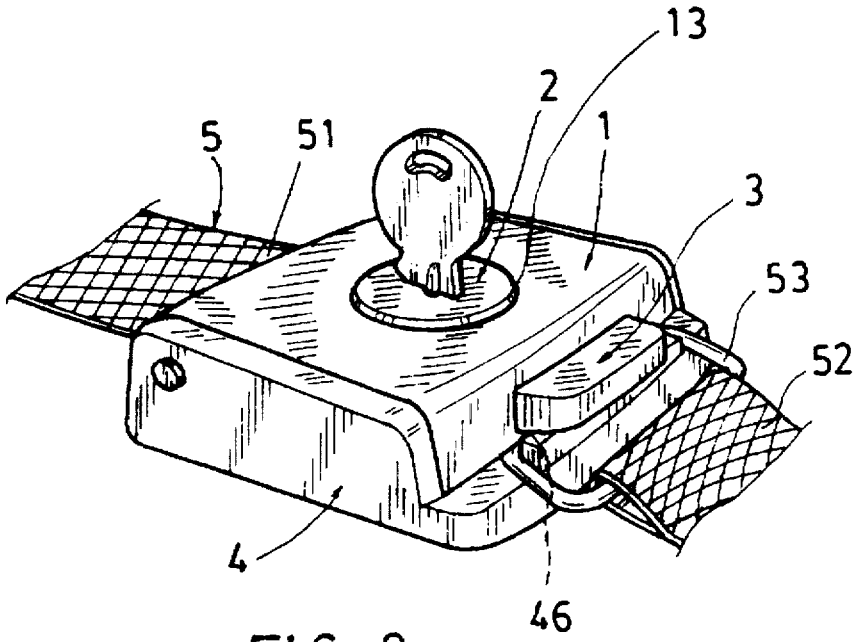
FIG. 8 shows further preferred embodiment of the present invention.
Figure 9:
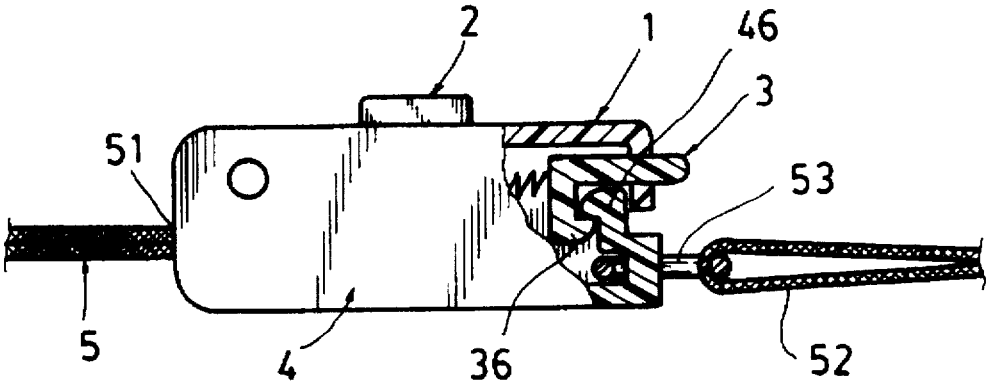
FIG. 9 is an illustration of the primary lock as provided in the embodiments of the present invention as shown in FIGS. 6–8.

The secondary lock 2 may be a combination lock with plural dials as shown in FIGS. 1–5; or may be a combination lock with single dial as shown in FIG. 6; or a push button type lock as shown in FIG. 7; or even a key-operated lock as shown in FIG. 8 or any other electronic locks, not limited in the present invention. The primary lock 3 provided in the preferred embodiments as shown in FIGS. 6–8 may be referred to that as shown in FIG. 9, in which the locking mechanism of the primary lock 3 is similar to the aforementioned, or otherwise modified.

Figure 3:
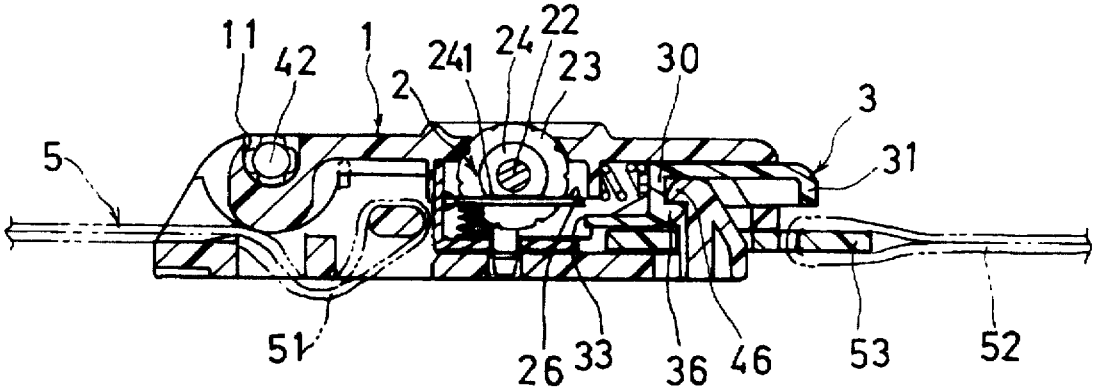
FIG. 3 shows an unlocked situation of the present invention when unlocking from FIG. 2.
Figure 4:
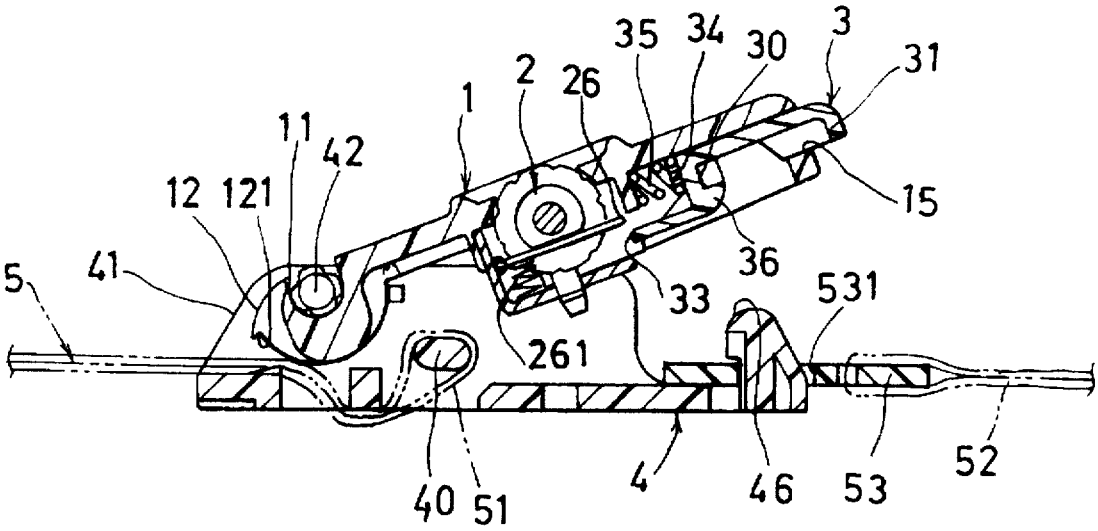
FIG. 4 shows a lifting of the cover member of the present invention.

The secondary lock 2 includes: a lock casing 21 combined with the cover member 1, an axle 22 longitudinally fixed in the lock casing 21 for rotatably mounting a plurality of dials 23 and sleeves 24 on the axle 22, a coupling spring 25 retained on the axle 22 for resiliently coupling each dial 23 with each sleeve 24 for a coupled rotation of each dial 23 and each sleeve 24, and a stopper plate 26 pivotally secured in the lock casing 21 and operatively biased inclinedly by a periphery of each sleeve 24 to stop the retarding extension 33 of the primary lock 3 for locking the primary lock 3 (FIG. 2), and resiliently restored horizontally by a stopper restoring spring 261 by engaging a secant portion 241 of each sleeve 24 with the stopper plate 26 for unlocking the primary lock 3 as the stopper plate 26 will no longer obstruct the retraction of the retarding extension 33 (FIG. 3). The cover member 1 will then be opened to remove the buckle member 53 of the belt 5.

As shown in FIG. 5, an actuating rod 27 is secured to the axle 22 for moving the sleeves 24 to be separated from the dials 23 for a free rotation of the dials 23 for resetting a new combination therefor.

The present invention plays a double security effect for safely locking the fastening belt by the primary lock 3 and the secondary lock 2. The end 52 of the belt 5 may be first locked in the housing 100 as locked by the primary lock 3 which may then be conveniently unlocked just by depressing the tongue portion 31 inwardly. By manipulating the dials 23 of the secondary lock 2, the primary lock 3 will be locked for a safer locking of the belt 5.

The locks 2, 3 may be suitably modified by those skilled in the art without departing from the spirit and scope as claimed in this invention. The preferred embodiments as aforementioned are provided to explain the present invention, not to limit the scope of this invention. The cover member 1 is pivotally secured with the base member 4 for combining the two members 4, 1 for forming the housing 100. Other joining methods may also be applied for combining the cover member 1 with the base member 4 to form the housing 100.

I claim:

1. A belt locking device comprising:

a housing including a base member having a first belt end of a fastening belt fixed in the base member and having a base engaging portion formed on the base member for detachably engaging a second belt end of the fastening belt, and a cover member combinable with the base member;

a primary lock resiliently slidably held in the cover member and partially protruding outwardly from the cover member and having a movable engaging portion formed on the primary lock to be engageable with the base engaging portion of the base member for locking the second belt end of the fastening belt in between the cover member and the base member of the housing, whereby upon depression of the primary lock to disengage the movable engaging portion of the primary lock from the base engaging portion of the base member, the second belt end of the fastening belt is removable from the base member; and a secondary lock secured in the housing, and operatively locking and unlocking the primary lock within the housing;

the improvement which comprises:

said secondary lock formed as a module means directly secured in the cover member;

said base member including: at least a pair of side walls having a pair of pivots formed on the pair of side walls for pivotally mounting the cover member on the base member, a belt bar transversely formed in the base member for securing the first belt end the fastening belt, and at least one said base engaging portion protruding upwardly from the base member for engaging the second belt end of the fastening belt and for engaging the movable engaging portion of said primary lock as controlled by said secondary lock;

said cover member including: a pair of pivot holes formed in two opposite side portions of the cover member for pivotally engaging the two pivots formed on the base member, at least a manipulating slot formed through the cover member for protruding a portion of the secondary lock for locking and unlocking of the secondary lock, a pair of stems each said stem protruding downwardly from the cover member having a bottom hook portion formed on a bottom of the stem for engaging a bottom hook hole formed in a lock bottom plate of a lock casing of the secondary lock, and a tongue slot transversely formed in the cover member for protruding a portion of the primary lock through the tongue slot when unlocking the primary lock; and said primary lock including: a tongue portion protruding outwardly from a shoulder portion of the primary lock to be slidably held in the tongue slot in the cover member, a pair Of side arm portions protruding inwardly from the shoulder portion and located within the cover member, a retarding extension protruding inwardly from the shoulder portion and retractably obstructed by the secondary lock when locked, at least a latch restoring spring held on a spring retainer formed on the shoulder portion, and at least a movable engaging portion protruding downwardly from the cover member to be engageable with a base engaging portion of the base member for locking the primary lock on the base member.

2. A belt locking device according to claim 1, wherein said secondary lock for controlling said primary lock is selected from the group consisting of: a combination lock, a key-operated lock, a manually operated lock, and an electronic lock.

3. A belt locking device according to claim 1, wherein said secondary lock includes: a lock casing securable with the cover member, an axle longitudinally fixed in the lock casing for rotatably mounting a plurality of dials and sleeves on the axle, a coupling spring retained on the axle for resiliently coupling each said dial and each said sleeve for a coupled rotation of each said dial and each said sleeve, and a stopper plate pivotally secured in the lock casing and operatively biased inclinedly by a periphery of each said sleeve to obstruct an inward retraction of the retarding extension of the primary lock for locking the primary lock, and resiliently restored horizontally by a stopper restoring spring held in said lock casing by engaging a secant portion formed on each said sleeve with the stopper plate for unlocking the primary lock allowing an inward retraction of the retarding extension; and said secondary lock including an actuating rod secured on the axle for moving the sleeves to be separated from the dials for a free rotation of the dials for resetting a new combination therefor.

* * * * *